United States Patent [19]

Ichikawa et al.

[11] 3,942,995

[45] Mar. 9, 1976

[54] NOVEL PAPER COATING COMPOSITION

[75] Inventors: Atsushi Ichikawa; Norihiko Adachi; Masayoshi Kawanabe, all of Yokkaichi; Yozi Hisada, Akashi; Yuichi Kohzaki, Takasago, all of Japan

[73] Assignee: Kanegaufchi Chemical Industries, Co. Ltd., Osaka, Japan

[22] Filed: Jan. 22, 1973

[21] Appl. No.: 325,797

[30] Foreign Application Priority Data

Jan. 25, 1972 Japan ..... 47-9234

[52] U.S. Cl. ..... 106/124; 106/148; 106/149; 106/170; 106/193 R; 106/214; 260/6; 260/7; 260/8

[51] Int. Cl.[2] ..... C08L 89/00; C08H 1/00

[58] Field of Search ..... 260/6–8; 106/124, 170, 193, 148, 149

[56] References Cited

UNITED STATES PATENTS

| | | | |
|---|---|---|---|
| 2,031,668 | 2/1936 | Reich | 195/98 |
| 3,716,504 | 2/1973 | Lindermann | 260/8 |
| 3,781,264 | 12/1973 | Oakbrook | 106/124 |

FOREIGN PATENTS OR APPLICATIONS

| | | |
|---|---|---|
| 313,101 | 6/1929 | United Kingdom |
| 328,645 | 4/1930 | United Kingdom |
| 328,197 | 4/1930 | United Kingdom |

OTHER PUBLICATIONS

Chem. Abstract 52: 15,103b.

Chem. Abst., Vol. 45: 5423g.

*Primary Examiner*—Theodore Morris

*Attorney, Agent, or Firm*—Sughrue, Rothwell, Mion, Zinn & Macpeak

[57] ABSTRACT

A paper coating composition comprising (A) a pigment as a main ingredient and (B) a binder for said pigment which is either (a) an alkali decomposition product of a yeast or (b) a mixture of said alkali decomposition product of a yeast and an emulsion of a synthetic polymer and/or an aqueous solution of a natural or snythetic polymer and the paper coating composition coated paper product are disclosed.

13 Claims, No Drawings

NOVEL PAPER COATING COMPOSITION

BACKGROUND OF THE INVENTION

1. Field of the Invention

This invention relates to a novel paper coating composition, and more specifically to a paper coating composition which contains an alkali decomposition product of a yeast as a binder and which is suitable for the production of coated paper having excellent printability.

2. Description of the Prior Art

In printing paper such as coated paper or a certain kind of paper board, a pigment is coated on the surface of the paper. As a binder for the pigment, there have been previously used an aqueous solution of a natureal polymeric substance such as casein, soybean protein, modified starch or carboxymethyl cellulose or a synthetic polymeric material such as polyvinyl alcohol, and an emulsion of a synthetic polymer such as a latex of a styrene/butadiene copolymer, either alone or in admixture. Of these, casein has the advantages of maintaining better dispersing effect than starch or polyvinyl alcohol and also having better water resistance, and therefore is being used in great quantities in the coated paper industry. However, because the quality of casein differs greatly according to the place of origin and its cost has been rapidly on the increase as a result of the increased demand in recent years, great interest has been aroused in a substitute for casein.

On the other hand, water-soluble natural or synthetic polymeric materials such as modified starch, carboxymethyl cellulose or polyvinyl alcohol have recently been used in increasing quantities, but have not been able to supersede casein completely because of their inferior water resistance.

It has now been found that the use of an alkali decomposition product of a yeast as a binder for the pigment can lead to the removal of the above-mentioned defects, and makes it possible to provide a coated paper having high surface strength and water resistance and superior printability.

SUMMARY OF THE INVENTION

The present invention provides a paper coating composition comprisng a pigment as a main ingredient and a binder for said pigment, which is either (a) an alkali decomposition product of a yeast or (b) a mixture of said alkali decomposition product of a yeast and an emulsion of a synthetic polymer and/or an aqueous solution of a natural or synthetic polymer.

DETAILED DESCRIPTION OF THE INVENTION

Examples of the yeast that can be used in the present invention are baker's yeasts (*Saccharomyces cerviciae*), nucleic acid yeasts (such as *Candida utilis*), beer yeast (*Saccharomyces cerviciae*), pulp yeasts (such as *Candida utilis* or *Mycotorula japonica*) and yeasts which assimilate petrochemical products (such as methanol, acetic acid or n-paraffin) [for example, *Candida utilis*, *Candida novellus* (FRI deposit No. 705, see Japanese Patent Application No. 18562/70), or *Mycotorula japonica*, or *Pichia miso mogii*]. These yeasts may be raw yeasts as separated from the culture liquors, or dried yeasts obtained by drying the raw yeasts. Processed yeasts obtained by subjecting these yeasts to various treatments such as pulverization, elimination of nucleic acid, defatting, desalting, decolorization or autolysis are also useful in the present invention. Coated papers produced by using coating compositions using alkali decomposition products of yeasts cultivated using petrochemical products as a carbon source prove better in quality than the other yeasts.

These yeasts are used in the form of alkali decomposition products for preparing the paper coating compositions. Prior to alkali decomposition, the yeasts may be decolorized with a peroxide such as hydrogen peroxide or a reducing agent such as sodium boron hydrate. Alkalies used to decompose the yeasts may be sodium hydroxide, ammonia, slaked lime, sodium phosphate, sodium carbonate or borax. Of these, sodium hydroxide, ammonia or a mixture of these is preferred. The amount of the alklai used differs depending upon its type, but is usually such that will result in the adjustment of the pH of an aqueous suspension of the yeast to at least 8, preferably 9 to 13. A suspension of the yeast to which the alkali is added is heated usually at 30° to 120°C. for 10 minutes to 10 hours, preferably at 60° to 100°C. for 10 minutes to one hour, although the temperature and time vary depending upon the kind and amount of the alkali added, thereby to decompose the yeast. The resulting alkali decomposition product of the yeast may be used as such or after being subjected to post-treatment such as dialysis, desalting or acid addition if desired.

The pigment used in this invention is not particularly limited, but all pigments which are generally used for paper coating can be used effectively. Examples are clay, titanium oxide, satin white, and calcium carbonate.

In the paper coating composition, 5 to 50 parts by weight of the pigment binder are generally used per 100 parts by weight of the pigment. As the pigment binder, a mixture of the afore-mentioned alkali decomposition product of yeast and at least one emulsion of a synthetic polymer or aqueuos solution of a natural or synthetic polymer may also be used. Aqueous emulsions (latices) of a styrene/butadiene copolymer, butadiene/methyl methacrylate copolymer, styrene/butadiene/methyl methacrylate copolymer, ethylene/vinyl acetate copolymer, polyvinyl acetate, vinyl acetate/acrylate copolymer, styrene/acrylate copolymer, styrene/vinyl acetate copolymer, or these polymers modified with monomers containing functional groups are conveniently used as the emulsion of synthetic polymer. Examples of the water-soluble natural or synthetic polymer are casein, soybean protein, modified starch, polyvinyl alcohol or carboxymethyl cellulose. If desired, the paper coating composition of this invention may further contain auxiliary agents usually employed in pigment coated papers, such as a foam control agent, lubricant, surface active agent, insolubilizer, dispersing agent for the pigment or viscosity controlling agent.

The present invention will be illustrated specifically by the following Examples which do not limit the scope of the invention and in which all parts and percentages are by weight unless otherwise specified.

EXAMPLE 1

100 parts of Georgia kaolin were added gradually with agitation to 46 parts of an aqueous solution containing 0.3 part of sodium hexametaphosphate (SHMP) as a dispersing agent, thereby forming a slurry of the pigment. A 10% suspension (pH 11.5) of yeast (*Candida novellus*) composed of 100 parts of water, 10 parts of the yeast and 0.5 part of sodium hydroxide was heated with agitation at 50°C. for one hour to form a liquor containing an alkali decomposition product of the yeast.

To the pigment slurry were added the decomposed yeast and 10 parts (as solids content) of a late of a styrene/butadiene type copolymer (JSR 0668, tradename of product manufactured by Japan Synthetic Rubber Co., Ltd.) to form a coating composition having a total solids concentration of 40%.

For comparison, a coating composition was prepared by a customary method using commercially available casein or oxidized starch instead of the decomposition product of the yeast. The formulations and properties of these coating compositions are shown in Table 1—1.

Table 1-1

| | Composition 1 (present invention | Comparative composition A | Comparative composition B |
|---|---|---|---|
| Georgia kaolin | 100 parts | 100 parts | 100 parts |
| SHMP | 0.3 | 0.3 | 0.3 |
| JSR 0668 | 10 | 10 | 10 |
| Sodium hydroxide | 0.5 | 0.4 | — |
| Yeast | 10 | — | — |
| Casein | — | 10 | — |
| Oxidized starch | — | — | 10 |
| pH | 9.4 | 8.9 | 7.3 |
| Viscosity *1 | 75.0 | 78.5 | 42.5 |

*1 - Measured at 20°C at 60 rpm on a BL type viscometer, rotor No. 2 (unit: cps)

Each of the above coating compositions was coated on high quality paper to an extent such that the coating weight was 10 g/m². After coating, the coated paper was allowed to stand overnight in an air-conditioned chamber kept at 20°C and a relative humidity of 65%, and then subjected to supercalendering at 70°C. and 135 Kg/cm. The surface strength (IGT pick resistance), water resistance and air permeability of the coated paper are shown in Table 1–2.

Table 1-2

| | Composition 1 (present invention) | Comparative composition A | Comparative composition B |
|---|---|---|---|
| IGT pick resistance *2 | 185 | 154 | 148 |
| Water resistance *3 | excellent | excellent | fair |
| Air-permeability *4 | 727 | 1,158 | 645 |

*2 - Measured at a printing pressure of 35 Kg/cm² with a spring strength of M on an IGT printability tester using printing ink having a tack value of 16; unit cm/sec.
*3 - The paper is imprinted after applying water to the coated surface, using an RI printability tester. The state of picking is evaluated on a scale of excellent, good, fair and poor.
*4 - Measured on an air-permeability and smoothness tester of the Bekk type; unit seconds.

The above table demonstrates that the paper coated with the composition of this invention has superior IGT pick resistance and air-permeability to the paper coated with the composition containing casein, and superior IGT pick resistance and water resistance to the paper coated with the composition containing oxidized starch.

EXAMPLE 2

A coating composition was prepared in the same way as in Example 1 except that 10 parts of *Candida utilis* was used as the yeast and decomposed with 1 part of sodium hydroxide by heating for 30 minutes at 80°C. (pH 12.8). The coated paper was subjected to the same test as in Example 1. The results are shown in Table 2.

Table 2

| | Composition 2 (present invention) | Comparative composition A (casein) | Comparative composition B (oxidized starch) |
|---|---|---|---|
| IGT pick resistance | 197 | 154 | 148 |
| Water resistance | excellent | excellent | fair |
| Air-permeability | 867 | 1,158 | 645 |

As is clear from Table 2, the composition of this invention exhibited similar properties to that obtained in Example 1.

EXAMPLE 3

A coating composition was prepared in accordance with the formulation shown in Table 3–1 using a decomposition product of a Saccharomyces yeast obtained by decomposing the yeast with sodium hydroxide (5% of the yeast) and ammonia (53% of the yeast as $NH_4OH$) at 30°C for 10 hours (pH 12.8). For comparison, coating compositions were prepared similarly using casein or oxidized starch. The properties of the coated papers (with coating weight of 20 g/m² as solids content) are shown in Table 3–2.

Table 3-1

| | Composition 3 (present invention) | Comparative composition C | Comparative composition D |
|---|---|---|---|
| Georgia kaolin | 100 parts | 100 parts | 100 parts |
| SHMP | 0.3 | 0.3 | 0.3 |
| JSR 0668 | 10 | 10 | 10 |
| Yeast | 5 | — | — |
| Casein | 5 | 10 | — |
| Oxidized starch | — | — | 10 |
| Sodium hydroxide | 0.25 | — | — |
| Ammonia (as $NH_4OH$) | 3.15 | 1.0 | — |
| pH | 10.9 | 9.9 | 7.5 |

Table 3-2

| | Composition 3 (present invention) | Comparative composition C | Comparative composition D |
|---|---|---|---|
| IGT pick resistance | 220 | 210 | 90 |
| Water resistance | excellent | excellent | fair |
| Air-permeability | 5250 | 5400 | 3850 |

EXAMPLE 4

90 parts of Georgia kaolin was gradually added with agitation to 40 parts of water in which 0.27 part of sodium hexametaphosphate (SHMP) had been dissolved as a dispersing agent, to form a slurry of the clay.

Separately, 10 parts of water in which 0.3 part (as solids content) of poly (sodium acrylate (Aron A-20SL$_2$, tradename of the product of Toa Gosei Co., Ltd.) was dissolved as a dispersant were added to 10 parts (as solids content) of satin white (product of Shiraishi Kogyo Co., Ltd.). The mixture was agitated thoroughly to form a slurry of satin white.

Sodium silicate was added to a suspension composed of 70 parts of water and 10 parts of *Candida novellus* to adjust its pH to 5. To this suspension was added 0.5 part by volume of 30% aqueous hydrogen perioxide, and the mixture was shaken for one hour at 30°C, followed by adding 2.5 parts by volume of 10% sodium hydroxide and then 20 parts by volume of 28% aqueous ammonia. The mixture was heated at 75°C for one hour to form a solution containing the decomposed yeast.

The satin white slurry was added to the clay slurry, and with stirring the decomposed yeast, 10 parts (as solids content) of a styrene/butadiene type copolymer latex (JSR 0668), and water were added to form a coating composition having a total solids concentration of 40%.

For comparison, a coating composition was prepared by a customary method using commercially available casein instead of the decomposition product of the yeast. The formulations and properties of these coating compositions are shown in Table 4–1 below.

Each of the above coating compositions was coated on base paper board to an extent such that the coating weight was 20 g/m$^2$, and then air dried. The surface of the coated paper board was treated with a 30% aqueous solution of zinc sulfate, and dried by being left to stand overnight in an airconditions chamber at 20°C and a relative humidity of 65%.

The surface strength (IGT pick resistance) and water resistance of the resulting coated papers are shown in Table 4–2. It is seen from Table 4–2 that the paper board coated with the composition of this invention has superior IGT pick resistance and equivalent water resistance to the paper coated with the composition containing casein.

Table 4-1

| | Composition 4 (present invention) | Comparative composition E |
|---|---|---|
| Georgia kaolin | 90 parts | 90 parts |
| SHMP | 0.27 | 0.27 |
| Satin white | 10 | 10 |

Table 4-1-continued

| | Composition 4 (present invention) | Comparative composition E |
|---|---|---|
| Poly(sodium acrylate) | 0.3 | 0.3 |
| JSR 0668 | 10 | 10 |
| Yeast | 10 | — |
| Casein | — | 10 |
| Sodium hydroxide | 0.25 | 0.4 |
| 28% aqueous ammonia | 20 | — |
| 30% aqueous hydrogen peroxide | 0.5 | — |
| pH | 11.3 | 10.4 |
| Viscosity | 133 | 83.0 |

Table 4-2

| | Composition 4 (present invention) | Comparative composition E |
|---|---|---|
| IGT pick resistance | 181 cm/sec. | 154 cm/sec. |
| Water resistance | excellent | excellent |

EXAMPLE 5

90 parts of Georgia kaolin were gradually added with stirring to 60 parts of water in which 0.27 part of sodium hexametaphosphate (SHMP) was dissolved as a dispersant, to form a slurry of the clay.

Separately, to 10 parts (as solids content) of satin white (product of Shiraishi Kogyo Co., Ltd.) was added 20 parts of water in which 0.3 part (as solids content) of poly(sodium acrylate (Aron A-20SL$_2$) was dissolved as a dispersant, to form a slurry of the satin white.

To a suspension composed of 10 parts of yeast (*Candida utilis*) and 40 parts of water, was added 1.4 parts of sodium peroxide, and the mixture was shaken for one hour at 30°C. Then, 20 parts by volume of 28% aqueous ammonia were added, and the mixture was treated at 30°C. for 24 hours, thereby to form a solution of the decomposition product of the yeast.

The satin white slurry was added to the above clay slurry, and with stirring, the decomposed yeast, 12 parts (as solids content) of a latex of methyl methacrylate/butadiene type copolymer (JSR 0933, product of Japan Synthetic Rubber Co., Ltd.), and water were added to form a coating composition having a total solids concentration of 40%. For comparison, a coating composition was prepared in a customary manner using modified polyvinyl alcohol (PVA, Denka Size PC-100, Denki Kagaku Kogyo Co., Ltd.) instead of the decomposed yeast. The formulations and properties of these coating compositions are shown in Table 5–1.

Each of the above coating compositions was coated on base paper board to an extent such that the amount of coating was 20 g/m$^2$, and then dried. The surface of the coated paper was treated with a 3% aqueous solution of zinc sulfate, and dried by being left to stand overnight in an air-conditioned chamber kept at 20°C and relative humidity of 65%.

The surface strength (IGT pick resistance) and water resistance of the coated papers are shown in Table 5–2. It is seen that the paper board coated with the composition of this invention has superior IGT pick resistance and water resistance to the paper coated with the composition containing the modified polyvinyl alcohol.

Table 5-1

| | Composition 5 (present invention) | Comparative composition F |
|---|---|---|
| Georgia kaolin | 90 parts | 90 parts |
| SHMP | 0.27 | 0.27 |
| Satin white | 10 | 10 |
| Poly(sodium acrylate) | 0.3 | 0.3 |
| JSR 0933 | 12 | 12 |
| Denka PC-100 | — | 4 |
| Yeast | 4 | — |
| Sodium peroxide | 1.4 | — |
| 28% aqueous ammonia | 20 | — |
| pH | 10.8 | 7.3 |
| Viscosity | 38 | 172 |

Table 5-2

| | Composition 5 (present invention) | Comparative composition F |
|---|---|---|
| IGT pick resistance | 137 cm/sec. | 77 cm/sec. |
| Water resistance | excellent | good |

While the invention has been described in detail and with reference to specific embodiments thereof, it will be apparent to one skilled in the art that various changes and modifications can be made therein without departing from the spirit and scope thereof.

What is claimed is:

1. A paper coating composition comprising (A) a pigment as a main ingredient and (B) as a binder for said pigment an alkali decomposition product of a yeast produced by heating said yeast with alkali at 30°–100°C for ten minutes to ten hours, said yeast being decolored prior to alkali decomposition with sodium boron hydrate as a reducing agent.

2. The composition of claim 1 wherein the amount of said binder is 5 to 50 parts by weight per 100 parts by weight of said pigment.

3. The composition of claim 1 wherein said yeast is selected from the group consisting of baker's yeasts, nucleic acid yeasts, beer yeasts, pulp yeasts, and yeasts which assimilate petrochemical products.

4. The composition of claim 1 wherein said yeast is at least one yeast which assimilates methanol, acetic acid or n-paraffin.

5. The composition of claim 1 wherein said yeast is selected from the group consisting of Saccaromyces genus, Candida genus, Mycotorula genus and Pichia genus.

6. The composition of claim 1 wherein said yeast is heated with the alkali at 60° to 100°C for 10 minutes to one hour.

7. The composition of claim 1 wherein said alkali is selected from the group consisting of sodium hydroxide, ammonia, slaked lime, sodium phosphate, sodium carbonate and borax.

8. The composition of claim 1 wherein said alkali is sodium hydroxide, ammonia or a mixture thereof.

9. The composition of claim 1 wherein the amount of the alkali is such that the pH of an aqueous suspension of the yeast reaches at least 8.

10. The composition of claim 9 wherein the pH of an aqueous suspension of the yeast is 9 to 13.

11. The composition of claim 1 wherein said binder is a mixture of said alkali decomposition product of a yeast and an emulsion of a synthetic polymer selected from the group consisting of emulsions of a styrene/-butadiene copolymer, butadiene/methyl methacrylate copolymer, styrene/butadiene/methyl methacrylate copolymer, ethylene/vinyl acetate copolymer, polyvinyl acetate, vinyl acetate/acrylate copolymer, styrene/acrylate copolymer and styrene/vinyl acetate copolymer.

12. The composition of claim 1 wherein said binder is a mixture of said alkali decomposition product of a yeast and an aqueous solution of a water-soluble natural or synthetic polymer selected from the group consising of casein, soybean protein, oxidized starch, polyvinyl alcohol and carboxymethyl cellulose.

13. The composition of claim 1 wherein said pigment is selected from the group consisting of clay, titanium oxide, satin white and calcium carbonate.

* * * * *